US011479865B2

(12) United States Patent
Brouwer et al.

(10) Patent No.: US 11,479,865 B2
(45) Date of Patent: Oct. 25, 2022

(54) METHOD FOR ZINC PHOSPHATING METAL COMPONENTS IN SERIES IN A SLUDGE-FREE MANNER SO AS TO FORM LAYERS

(71) Applicant: Henkel AG & Co. KGaA, Duesseldorf (DE)

(72) Inventors: Jan-Willem Brouwer, Willich (DE); Frank-Oliver Pilarek, Bergheim (DE); Fernando Jose Resano Artalejo, Duesseldorf (DE); Jens Kroemer, Neuss (DE); Matthias Hamacher, Huerth (DE); Marc Balzer, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 329 days.

(21) Appl. No.: 16/593,520

(22) Filed: Oct. 4, 2019

(65) Prior Publication Data

US 2020/0032402 A1 Jan. 30, 2020

Related U.S. Application Data

(63) Continuation of application No. PCT/EP2018/055695, filed on Mar. 8, 2018.

(30) Foreign Application Priority Data

Apr. 21, 2017 (EP) ..... 17167467

(51) Int. Cl.
*C23C 22/00* (2006.01)
*C23F 11/18* (2006.01)
*C23C 22/36* (2006.01)

(52) U.S. Cl.
CPC ..... *C23F 11/188* (2013.01); *C23C 22/365* (2013.01)

(58) Field of Classification Search
CPC ..... C23C 22/365; C23C 22/78; C23C 22/362; C23C 22/73
See application file for complete search history.

(56) References Cited

U.S. PATENT DOCUMENTS 6,723,178 B1 * 4/2004 Bannai ..... C23C 22/13 148/253
2012/0286909 A1 * 11/2012 Oh ..... H01F 41/0246 335/297
2014/0305803 A1 10/2014 McMillen et al.

FOREIGN PATENT DOCUMENTS

| | | | |
|---|---|---|---|
| CN | 1665957 | A | 9/2005 |
| CN | 101384750 | A | 3/2009 |
| CN | 102027157 | A | 4/2011 |
| CN | 102959127 | A | 3/2013 |
| EP | 1988189 | A1 | 11/2008 |
| EP | 2343399 | A1 | 7/2011 |
| JP | 2006183144 | A | 7/2006 |
| JP | 2006528280 | A | 12/2006 |
| WO | 9839498 | A1 | 9/1998 |
| WO | 0112341 | A1 | 2/2001 |
| WO | 2004007799 | A2 | 1/2004 |
| WO | 2016162422 | A1 | 10/2016 |

OTHER PUBLICATIONS

International Search Report for PCT/EP2018/055695, dated Jun. 6, 2018.
International Search Report for PCT/EP2018/055871, dated Jun. 7, 2018.
EP Search Report for EP 17167478 dated Oct. 20, 2017.
EP Search Report for EP 17167467 dated Oct. 19, 2017.

* cited by examiner

*Primary Examiner* — Hai Y Zhang
(74) *Attorney, Agent, or Firm* — Mary K. Cameron

(57) ABSTRACT

The invention relates to a method for zinc phosphating components so as to form layers, said components comprising surfaces made of steel with a high tolerance against aluminum dissolved in the zinc phosphating bath, wherein the precipitation of poorly soluble aluminum salts can be largely prevented. In the method, a process is used of activating the zinc surfaces by means of dispersions containing particulate hopeite, phosphophyllite, scholzite, and/or hureaulite, wherein the proportion of particulate phosphates in the activation process must be adapted to the quantity of free fluoride and dissolved aluminum in the zinc phosphation.

17 Claims, No Drawings

METHOD FOR ZINC PHOSPHATING METAL COMPONENTS IN SERIES IN A SLUDGE-FREE MANNER SO AS TO FORM LAYERS

The present invention relates to a method for the layer-forming zinc phosphating of components comprising steel surfaces with high tolerance to aluminum dissolved in the zinc phosphating bath, in which method the precipitation of sparingly soluble aluminum salts can be largely avoided. In the method, activation of the zinc surfaces by means of dispersions containing particulate hopeite, phosphophyllite, scholzite and/or hureaulite is used, the proportion of particulate phosphates in the activation having to be adapted to the amount of free fluoride and dissolved aluminum in the zinc phosphating.

Zinc phosphating is a method for applying crystalline anti-corrosion coatings to metal surfaces, in particular to materials of the metals iron, zinc and aluminum, which has been used for decades and has been studied in depth. Zinc phosphating is carried out in a layer thickness of a few micrometers and is based on a corrosive pickle of the metal material in an acidic aqueous composition containing zinc ions and phosphates, which precipitate as sparingly soluble crystallites in an alkaline diffusion layer directly on the metal surface phase boundary and further undergo epitaxial growth thereon. To support the pickling reaction to materials of the metal aluminum and to mask the bath poison aluminum, which in dissolved form disturbs the layer formation on materials of the metal, water-soluble compounds are often added which are a source of fluoride ions. Zinc phosphating is always initiated with an activation of the metal surfaces of the component to be phosphated. Wet-chemical activation is carried out conventionally by means of contact with colloidal dispersions of phosphates, which, insofar as they are immobilized on the metal surface, are used in the subsequent phosphating as a growth nucleus for the formation of a crystalline coating. Suitable dispersions are colloidal, mostly alkaline aqueous compositions based on phosphate crystallites, which have only small crystallographic deviations in their crystal structure from the type of zinc phosphate layer to be deposited. In addition to the titanium phosphate commonly referred to in the literature as Jernstedt salt, water-insoluble bi- and trivalent phosphates are also suitable as starting materials for providing a colloidal solution suitable for activating a metal surface for the zinc phosphating. In this connection, WO 98/39498 A1 for example teaches in particular bi- and trivalent phosphates of the metals Zn, Fe, Mn, Ni, Co, Ca and Al, in which phosphates of the metal zinc are technically preferably used for activation for subsequent zinc phosphating.

Any type of layer-forming phosphating as a process sequence of activation and zinc phosphating has unique characteristics, which become significant particularly in the treatment of components composed of a mix of different metal materials, or also in the treatment of novel materials. For example, it is known that a homogeneous layer formation on the surfaces of the material iron in the presence of aluminum ions does not succeed and necessitates masking with fluoride ions. The masking of the aluminum ions, however, reaches its limits when high levels of aluminum enter the zinc phosphating bath and, in turn, aluminum ions in equilibrium disturb the formation of defect-free coatings on the steel surfaces. In the prior art, therefore, the aluminum dissolved in the zinc phosphating is at least partially removed from the zinc phosphating bath. Frequently, high contents of aluminum dissolved in water are also limited by the precipitation of cryolite or elpasolite in the presence of sodium and/or potassium ions. Cryolite or elpasolite precipitation is technically complicated to control and requires, in order to prevent the formation of incrustations, removal of the sludge from the bath and, to prevent defects in the dip coating, an intensive rinse after the zinc phosphating in order to remove to very fine deposition of cryolite or elpasolite crystallites from the phosphated surfaces. WO 2004/007799 A2 therefore proposes to carry out phosphating at the lowest possible levels of sodium and/or potassium ions such that a separate precipitation range for aluminum ions does not have to be provided, with dissolved aluminum contents above 0.1 g/l being considered not to be detrimental, but a more preferred range of 0.01-0.4 g/l for dissolved aluminum being given for the phosphating of components produced at least in part from aluminum.

The object of the present invention is therefore to find suitable conditions for a method for the zinc phosphating of metal components which also tolerates high proportions of dissolved aluminum, for which conditions zinc phosphate coatings that are largely defect-free on the steel surfaces succeed, such that excellent coating adhesion results overall. In particular, a method is to be provided in which metal components can be treated in the phosphating stage in a layer-forming manner, the surfaces of which components are formed of metal materials of the element iron and metal materials of the element aluminum. The care needs of the zinc phosphating bath should also be as low as possible and ideally the steady-state equilibrium concentration set by the pickling input and drag-out should be unproblematic in the treatment of a series of components for the phosphating performance on the steel surfaces of the components. It is also desirable for the method, in spite of the high aluminum contents, not to be prone to precipitating sparingly soluble aluminum salts, for example in the form of cryolite and/or elpasolite, since with such precipitation there are significant disadvantages for the method due to sludge formation and often poorer corrosion protection after coating with a dipping coating due to very fine inclusions of cryolite or elpasolite crystallite inclusions.

This object is surprisingly achieved by adapting the proportion of particulate phosphates contributing to the activation to the amount of free fluoride and aluminum ions dissolved in water in the zinc phosphating.

Accordingly, the present invention relates to a method for the anti-corrosion treatment of a series of metal components, the series comprising components that have, at least in part, iron surfaces, in which method the metal components of the series successively undergo the following wet-chemical treatment steps:

(I) activation by being brought into contact with an alkaline aqueous dispersion that has a D50 value of less than 3 μm and the inorganic particulate constituent of which comprises phosphates, the entirety of these phosphates being composed at least in part of hopeite, phosphophyllite, scholzite and/or hureaulite;

(II) zinc phosphating by being brought into contact with an acidic aqueous composition containing
  (a) 5-50 g/l of phosphate ions,
  (b) 0.3-3 g/l of zinc ions,
  (c) at least 15 mmol/kg of aluminum ions in dissolved form, and
  (d) at least one source of fluoride ions, characterized in that the concentration of phosphates in the form of particulate phosphate in mmol/kg, calculated as $PO_4$ in the alkaline aqueous dispersion, is greater than seven hundredths of the following term in mmol/kg:

$$\frac{[Al]^2}{3[Al]+[F]\cdot(1+10^{3.12-pH})} \quad \text{(Eq. 1)}$$

[Al]: concentration of aluminum ions in dissolved form in mmol/kg

[F]: concentration of free fluoride in mmol/kg pH: pH of the acidic aqueous composition of the zinc phosphating The components treated according to the present invention can be three-dimensional structures of any shape and design that originate from a fabrication process, in particular also including semi-finished products such as strips, metal sheets, rods, pipes, etc., and composite structures assembled from said semi-finished products, the semi-finished products preferably being interconnected by means of adhesion, welding and/or flanging to form composite structures. Within the meaning of the present invention, a component is metal if at least 10% of its geometric surface is formed by metal surfaces.

When reference is made in the context of the present invention to the treatment of components having zinc, iron or aluminum surfaces, all surfaces of metal substrates or metal coatings that contain more than 50 at. % of the relevant element are included. For example, according to the invention, galvanized steel grades form zinc surfaces, whereas at the cutting edges and cylindrical grinding points of, for example, an automobile body which is made solely of galvanized steel, surfaces of iron can be exposed according to the invention. According to the invention, the components of the series which have at least partly zinc surfaces preferably have at least 5% zinc surfaces based on the component surface area. Steel grades such as hot-formed steel may also be provided with a metal coating of aluminum and silicon several microns thick as protection against scaling and as a shaping aid. A steel material coated in this way, even though the base material is steel, has an aluminum surface in the context of the present invention.

Anti-corrosion treatment of the components in series is when a large number of components are brought into contact with treatment solution provided in the respective treatment steps and conventionally stored in system tanks, the individual components being brought into contact successively and thus at different times. In this case, the system tank is the container in which the pretreatment solution is located for the purpose of anti-corrosion treatment in series.

The treatment steps of activation and zinc phosphating for a component of the anti-corrosion treatment in series are carried out "successively", unless they are interrupted by any other treatment than the subsequent wet-chemical treatment provided in each case.

Wet-chemical treatment steps within the meaning of the present invention are treatment steps which take place by bringing the metal component into contact with a composition consisting substantially of water and do not represent rinsing steps. A rinsing step is used exclusively for the complete or partial removal of soluble residues, particles and active components that are carried over by adhering to the component from a previous wet-chemical treatment step, from the component to be treated, without metal-element-based or semi-metal-element-based active components, which are already consumed merely by bringing the metal surfaces of the component into contact with the rinsing liquid, being contained in the rinsing liquid itself. The rinsing liquid can thus be merely city water.

The concentration of free fluoride in the acidic aqueous composition of the zinc phosphating can be determined potentiometrically at 20° C. in the relevant acidic aqueous composition of the zinc phosphating after calibration with fluoride-containing buffer solutions without pH buffering by means of a fluoride-sensitive measuring electrode.

The concentration of aluminum ions dissolved in the acidic aqueous composition of the zinc phosphating can be determined by means of atomic emission spectrometry (ICP-OES) in the filtrate of a membrane filtration of the acidic aqueous composition which is carried out using a membrane having a nominal pore size of 0.2 μm. Similarly, in the context of the present invention, the concentrations of other ions of metal or semimetal elements in the acidic aqueous composition of the zinc phosphating are to be determined in dissolved form.

The "pH" as used in the context of the present invention corresponds to the negative common logarithm of the hydronium ion activity at 20° C. and can be determined by means of pH-sensitive glass electrodes. Accordingly, a composition is acidic if its pH is below 7, and alkaline if its pH is above 7.

The preferred pH of the acidic aqueous composition of the zinc phosphating in the method according to the invention is above 2.5, particularly preferably above 2.7, but preferably below 3.5, particularly preferably below 3.3.

In the method according to the invention, the individual treatment steps of activation and zinc phosphating are coordinated in such a way that a homogeneous crystalline phosphate coating is always produced on the iron surfaces of the component without aluminum ions having to be removed from the zinc phosphating bath. In a preferred embodiment of the method according to the invention, the concentration of phosphates in the form of particulate phosphate, calculated in mmol/kg as $PO_4$ in the alkaline aqueous dispersion, is greater than 9 hundredths, particularly preferably one tenth, of the following term in mmol/kg:

$$\frac{[Al]^2}{3[Al]+[F]\cdot(1+10^{3.12-pH})} \quad \text{(Eq. 1)}$$

[Al]: concentration of aluminum ions in dissolved form in mmol/kg

[F]: concentration of free fluoride in mmol/kg pH: pH of the acidic aqueous composition of the zinc phosphating Good results in the zinc phosphating can still be achieved if the concentration of aluminum dissolved in the acidic aqueous composition is significantly above 15 mmol/kg. High tolerance values for the content of aluminum in steady-state equilibrium of a series treatment of a large number of components make it possible to increase the proportion of surfaces of aluminum that is to be treated together with the series of components. In a preferred embodiment of the method according to the invention, the concentration of aluminum ions in dissolved form in the acidic aqueous composition of the zinc phosphating is therefore greater than 30 mmol/kg. Above 100 mmol/kg of dissolved aluminum ions, the amount of particulate constituents containing phosphates that is necessary for sufficient activation of the iron surfaces is so high that the method becomes economically unattractive. It is therefore preferred according to the invention for the concentration of aluminum ions in dissolved form in the acidic aqueous composition of the zinc phosphating to be less than 100 mmol/kg, particularly preferably less than 60 mmol/kg, and more particularly preferably less than 45 mmol/kg.

The particulate constituent of the alkaline aqueous dispersion is the solid portion that remains after drying the retentate of an ultrafiltration of a defined partial volume of the alkaline aqueous dispersion having a nominal cutoff limit of 10 kD (NMWC: nominal molecular weight cut off). The ultrafiltration is carried out by adding deionized water ($\kappa<1$ $\mu Scm^{-1}$) until a conductivity of below 10 $\mu Scm^{-1}$ is measured in the filtrate. The inorganic particulate constituent of the alkaline aqueous dispersion is, in turn, that which remains when the particulate constituent obtained from the drying of the ultrafiltration retentate is pyrolyzed in a reaction furnace by supplying a $CO_2$-free oxygen flow at 900° C. without admixture of catalysts or other additives until an infrared sensor provides a signal identical to the $CO_2$-free carrier gas (blank value) in the outlet of the reaction furnace. The phosphates contained in the inorganic particulate constituent are determined as phosphorus content by means of atomic emission spectrometry (ICP-OES) after acid digestion of the constituent with aqueous 10 wt. % $HNO_3$ solution at 25° C. for 15 min, directly from the acid digestion.

For activation of the iron surfaces, it is important for the alkaline aqueous dispersion to have a D50 value of less than 3 μm, otherwise only very high and thus uneconomical proportions of particulate constituents can produce sufficient coating of the metal surfaces with particles that provide crystallization nuclei for the zinc phosphating. In addition, dispersions of which the particles are on average larger tend to sediment.

In a preferred embodiment of the method according to the invention, the D50 value of the alkaline aqueous dispersion of the activation is therefore less than 2 μm, particularly preferably less than 1 μm, the D90 value being preferably less than 5 μm such that at least 90 vol. % of the particulate constituents contained in the alkaline aqueous composition fall below this value.

The D50 value in this context denotes the volume-average particle diameter which does not exceed 50 vol. % of the particulate constituents contained in the alkaline aqueous composition. The volume-average particle diameter can be determined according to ISO 13320:2009 at 20° C. directly in the relevant composition by means of scattered light analysis according to the Mie theory from volume-weighted cumulative particle size distributions as the so-called D50 value, where spherical particles and a refractive index of the scattering particles of $n_D=1.52-i\cdot 0.1$ are assumed.

The active components of the alkaline dispersion, which effectively promote the formation of a closed zinc phosphate coating on the iron surfaces of the component in the subsequent phosphating and in this sense activate the iron surfaces, are composed primarily of phosphates which in turn are at least partially hopeite, phosphophyllite, scholzite and/or hureaulite. In this respect, activation is preferred in which the phosphate proportion of the inorganic particulate constituents of the alkaline aqueous dispersion of the activation is at least 30 wt. %, particularly preferably at least 35 wt. %, more particularly preferably at least 40 wt. %, calculated as $PO_4$ and based on the inorganic particulate constituent of the dispersion.

Activation within the meaning of the present invention is thus substantially based on the phosphates contained according to the invention in particulate form, the phosphates being preferably composed at least in part of hopeite, phosphophyllite and/or scholzite, particularly preferably hopeite and/or phosphophyllite and more particularly preferably hopeite. The hopeite, phosphophyllite, scholzite and/or hureaulite phosphates may be dispersed into an aqueous solution as finely ground powders or as powder paste triturated together with a stabilizer in order to provide the alkaline aqueous dispersion. Without taking into account water of crystallization, hopeites stoichiometrically comprise $Zn_3(PO_4)_2$ and the nickel-containing and manganese-containing variants $Zn_2Mn(PO_4)_3$, $Zn_2Ni(PO_4)_3$, whereas phosphophyllite consists of $Zn_2Fe(PO_4)_3$, scholzite consists of $Zn_2Ca(PO_4)_3$ and hureaulite consists of $Mn_3(PO_4)_2$. The existence of the crystalline phases hopeite, phosphophyllite, scholzite and/or hureaulite in the alkaline aqueous dispersion can be demonstrated by means of X-ray diffractometric methods (XRD) after separation of the particulate constituent by means of ultrafiltration with a nominal cutoff limit of 10 kD (NMWC) as described above and drying of the retentate to constant mass at 105° C.

Due to the preference for the presence of phosphates comprising zinc ions and having a certain crystallinity, methods for the formation of firmly adherent crystalline zinc phosphate coatings are preferred according to the invention in which the alkaline aqueous dispersion of the activation is at least 20 wt. %, preferably at least 30 wt. %, particularly preferably at least 40 wt. % of zinc in the inorganic particulate constituent of the alkaline aqueous dispersion, based on the phosphate content of the inorganic particulate constituent, calculated as $PO_4$.

However, activation within the meaning of the present invention is not intended to be achieved by means of colloidal solutions of titanium phosphates, since otherwise the layer-forming zinc phosphating on surfaces of iron, in particular steel, is not reliable and the advantage of thin phosphate coatings on aluminum that are effective in protecting against corrosion is not achieved. In a preferred embodiment of the method according to the invention, therefore, the proportion of titanium in the inorganic particulate constituent of the alkaline aqueous dispersion of the activation is preferably less than 5 wt. %, particularly preferably less than 1 wt. %, based on the inorganic particulate constituent of the dispersion. In a particularly preferred embodiment, the alkaline aqueous dispersion of the activation contains a total of less than 10 mg/kg, particularly preferably less than 1 mg/kg of titanium.

For sufficient activation of all metal surfaces selected from zinc, aluminum and iron, the proportion of the inorganic particulate constituents comprising phosphates should be adjusted accordingly. For this purpose, it is generally preferred if, in the method according to the invention, the proportion of phosphates in the inorganic particulate constituent, based on the alkaline aqueous dispersion of the activation, is at least 40 mg/kg, preferably at least 80 mg/kg, particularly preferably at least 150 mg/kg, calculated as $PO_4$. For economic reasons and for reproducible coating results, the activation should be carried out with maximally diluted colloidal solutions. It is therefore preferred for the proportion of the phosphates in the inorganic particulate constituent, based on the alkaline aqueous dispersion of the activation, to be less than 0.8 g/kg, particularly preferably less than 0.6 g/kg, more particularly preferably less than 0.4 g/kg, calculated as $PO_4$.

For good activation of components which have iron surfaces, it is also advantageous for the metal surfaces to be pickled only slightly during activation. The same applies to activation on the surfaces of aluminum and zinc. At the same time, the inorganic particulate constituents, in particular the insoluble phosphates, should undergo only a slight degree of corrosion. Accordingly, it is preferred in the method according to the invention for the pH of the alkaline aqueous dispersion in the activation to be greater than 8, particularly preferably greater than 9, but preferably less than 12, particularly preferably less than 11.

The second zinc phosphating treatment step immediately follows the activation with or without an intermediate rinsing step, such that each component of the series successively undergoes the activation followed by the zinc phosphating without an intermediate wet-chemical treatment step. In a preferred embodiment of the method according to the invention, neither a rinsing nor a drying step takes place between the activation and the zinc phosphating for the components of the series. A "drying step" within the meaning of the present invention denotes a process in which the surfaces of the metal component having a wet film are intended to be dried with the aid of technical measures, for example by supplying thermal energy or passing a stream of air over.

The zinc phosphating succeeds provided that the coordination according to the invention has been carried out together with the activation, generally using conventional phosphating baths that contain (a) 5-50 g/kg, preferably 10-25 g/kg, of phosphate ions,
(b) 0.3-3 g/kg, preferably 0.8-2 g/kg, of zinc ions, and
(c) at least one source of free fluoride.

In an embodiment that is preferred for environmental hygiene reasons, in total less than 10 ppm of nickel and/or cobalt ions are contained in the acidic aqueous composition of the zinc phosphating.

According to the invention, the amount of phosphate ions comprises the orthophosphoric acid and the anions of the salts of orthophosphoric acid dissolved in water, calculated as $PO_4$.

The proportion of the free acid in points in the acidic aqueous composition of the zinc phosphating is preferably at least 0.4, but preferably not more than 3, particularly preferably not more than 2. The proportion of free acid in points is determined by diluting 10 ml sample volume of the acidic aqueous composition to 50 ml and titrating with 0.1 N sodium hydroxide solution to a pH of 3.6. The consumption of ml of sodium hydroxide solution indicates the point number of the free acid.

In a preferred embodiment of the method according to the invention, the acidic aqueous composition of the zinc phosphating additionally comprises cations of the metals manganese, calcium, iron, magnesium and/or aluminum.

The conventional additivation of the zinc phosphating can also be carried out in an analogous manner according to the invention such that the acidic aqueous composition can contain the conventional accelerators such as hydrogen peroxide, nitrite, hydroxylamine, nitroguanidine and/or N-methylmorpholine N-oxide.

A source of free fluoride ions is essential for the process of layer-forming zinc phosphating on all metal surfaces of the component, insofar as these are selected from surfaces of iron, aluminum and/or zinc. If all surfaces of these metal materials, as constituents of the components treated as part of the series, are to be provided with a phosphate coating, the amount of the particulate constituents in the activation must be adapted to the amount of free fluoride required for layer formation in the zinc phosphating. For a closed and defect-free phosphate coating on the surfaces of iron, in particular steel, it is preferred in the method according to the invention for the amount of free fluoride in the acidic aqueous composition to be at least 0.5 mmol/kg. In addition, if surfaces of aluminum are also to be provided with a closed phosphate coating within the series of components to be treated, it is preferred in the method according to the invention for the amount of free fluoride in the acidic aqueous composition to be at least 2 mmol/kg. In general, it is advantageous for economic reasons, if, in the method according to the invention, the concentration of free fluoride in the acidic aqueous composition of the zinc phosphating is below 50 mmol/kg, particularly preferably below 40 mmol/kg, more particularly preferably below 30 mmol/kg. If, in addition, surfaces of zinc are also to be provided with a closed phosphate coating within the series of components to be treated, it is preferred in the method according to the invention for the concentration of free fluoride not to exceed values above which the phosphate coatings have loose phosphate adhesions that can easily be wiped off, since these adhesions cannot be avoided by an increased amount of particulate phosphates in the alkaline aqueous dispersion of the activation. Therefore, it is preferred for such components, if, in the method according to the invention, the concentration of free fluoride in the acidic aqueous composition of the zinc phosphating is below 8 mmol/kg.

The amount of free fluoride can be determined potentiometrically by means of a fluoride-sensitive measuring electrode at 20° C. in the relevant acidic aqueous composition after calibration with fluoride-containing buffer solutions without pH buffering. Suitable sources of free fluoride are hydrofluoric acid and the water-soluble salts thereof, such as ammonium bifluoride and sodium fluoride, as well as complex fluorides of the elements Zr, Ti and/or Si, in particular complex fluorides of the element Si. In a preferred embodiment of the method according to the invention, the source of free fluoride is therefore selected from hydrofluoric acid and its water-soluble salts and/or complex fluorides of the elements Zr, Ti and/or Si. Salts of hydrofluoric acid are water-soluble within the meaning of the present invention if their solubility in deionized water ($\kappa<1\ \mu Scm^{-1}$) at 60° C. is at least 1 g/L, calculated as F.

To avoid the precipitation of sparingly soluble aluminum salts, for example in the form of cryolite and/or elpasolite, the acidic aqueous composition of the zinc phosphating contains only limited amounts of sodium and/or potassium ions. In a preferred embodiment of the method according to the invention it is therefore the case that the total concentration of sodium and/or potassium ions in dissolved form in mmol/kg is less than the number 40, particularly preferably less than the number 30, more particularly preferably less than the number 20, divided by the third root of the concentration of aluminum ions in dissolved form.

As already mentioned, another advantage of the method according to the invention is that, in the course of said method, closed zinc phosphate coatings are also formed on surfaces of aluminum. Consequently, the series of components to be treated in the method according to the invention preferably also includes the treatment of components which have at least one surface of aluminum. It is irrelevant whether the zinc and aluminum surfaces are realized in a component composed of corresponding materials or in different components of the series. Therefore, in the method according to the invention, within the series, components that have aluminum surfaces are preferably also treated, the components of the series preferably also having aluminum surfaces in addition to the iron surfaces.

The method according to the invention, in which, in addition to surfaces of iron, surfaces of aluminum are also to be provided with a phosphate coating within the series of components to be treated and each component of the series is of the same composition, can be operated cost-effectively up to a pickling rate of aluminum predetermined by the actual drag-out from the zinc phosphating bath, without aluminum ions dissolved in the zinc phosphating having to be removed from the bath. This pickling rate, which is dependent on the drag-out from the zinc phosphating, is based on the total surface area of each component:

$$0.27 \cdot \frac{A}{100} \mathrm{gm}^{-2} \quad \text{(Eq. 2)}$$

A: actual drag-out from the zinc phosphating bath indicated in milliliters of the acidic aqueous composition per component and per square meter of the component In the treatment of the series of components, provided that the pickling rate falls below the value (Eq. 2), which is dependent on the drag-out, a steady-state concentration of dissolved aluminum of not more than 100 mmol/kg is achieved in the acidic aqueous composition of the zinc phosphating.

In the event that the pickling rate of aluminum exceeds the above-mentioned value which is predetermined by the drag-out from the zinc phosphating, it is advantageous, for the depletion of aluminum ions in the zinc phosphating bath and to regenerate said bath, for a partial volume of the acidic aqueous composition to be removed continuously or discontinuously from the zinc phosphating and an equally large partial volume to be supplied continuously or discontinuously to the zinc phosphating by means of one or more aqueous compositions of this kind, which, in each case based on the partial volume, have a higher concentration in comparison with the concentration of the corresponding ions in the removed partial volume, with respect to the phosphate ions, zinc ions and/or the source of fluoride ions, but, with respect to the aluminum ions in dissolved form, have a lower concentration than in the removed partial volume.

In the method according to the invention, a good coating primer for a subsequent dip coating, in the course of which a substantially organic cover layer is applied, is produced. Accordingly, in a preferred embodiment of the method according to the invention, the zinc phosphating, with or without an intermediate rinsing and/or drying step, but preferably with a rinsing step and without a drying step, is followed by dip coating, particularly preferably electrocoating, more particularly preferably cathodic electrocoating.

EXAMPLES

Aluminum (AA6014) and steel sheets (CRS) were treated in zinc phosphating baths with different levels of free fluoride and dissolved aluminum after prior activation with dispersions of particulate zinc phosphate and the appearance of the coatings was evaluated immediately after the zinc phosphating. Table 1 contains an overview of the activation and zinc phosphating compositions and the results of the evaluation of the quality of the coatings. The sheets underwent the following method steps in the sequence indicated:

A1) cleaning and degreasing by dipping at 55° C. for 180 seconds 15 g/L BONDERITE® C-AK 11566 (Henkel AG & Co. KGaA)

1.1 g/L BONDERITE® M-AD ZN-2 (Henkel AG & Co. KGaA)

5 g/L BONDERITE C-AD 1561 (Henkel AG & Co. KGaA)

2.2 g/L $NaHCO_3$ preparing with deionized water ($\kappa$<1 $\mu Scm^{-1}$); adjusting the pH to 10.8 using potassium hydroxide solution.

A2) cleaning and degreasing by spraying at 1 bar and 55° C. for 70 seconds using a composition as in A1)

B) rinsing with deionized water ($\kappa$<1 $\mu Scm^{-1}$) at 20° C. for 60 seconds C) dip activation at 20° C. for 30 seconds 0.6-4 g/kg PREPALENE® X (Nihon Parkerizing Co., Ltd.) contains 8.4 wt. % of zinc in the form of $Zn_3(PO_4)2*4H_2O$

| | |
|---|---|
| 200 mg/kg | $K_4P_2O_7$ |

preparing with deionized water ($\kappa$<1 $\mu Scm^{-1}$); adjusting the pH to 10.3 using $H_3PO_4$.

The D50 value of the dispersion for activation was 0.25 μm at 20° C., determined on the basis of the static scattered light analysis according to Mie theory in accordance with ISO 13320:2009 by means of particle analyzer HORIBA LA-950 (Horiba Ltd.) assuming a refractive index of the scattering particles of n=1.52−i·0.1.

D) zinc phosphating by immersion at 50° C. for 150 seconds:

| | |
|---|---|
| 1.2 g/kg | zinc |
| 1.0 g/kg | manganese |
| 0.9 g/kg | nickel |
| 15.3 g/kg | phosphate |
| 1.9 g/kg | nitrate |
| 2.0 g/kg | N-methylmorpholine-N-oxide |
| 20 mg/kg | hydrogen peroxide |

An amount of a source of fluoride and an amount of aluminum were added according to table 1.

Preparing with deionized water ($\kappa$<1 $\mu Scm^{-1}$); adjusting the pH to pH 3.0 using 10% NaOH Free acid: 1.1-1.3 points The free acid is determined from 10 ml sample volume diluted to 50 ml with deionized water and subsequent titration with 0.1 N NaOH to pH 3.6, the consumption of sodium hydroxide solution in milliliters corresponding to the amount of free acid in points.

The zinc phosphating baths were formulated without adding sodium salts. The proportion of sodium was less than 1 mg/kg.

E) Rinsing with deionized water ($\kappa$<1 $\mu Scm^{-1}$) at 20° C. for 60 seconds F) Drying at 50° C. in a drying cabinet after blowing off with compressed air It can be seen from Table 1 that satisfactory phosphate coatings which thus appear to the naked eye to be homogeneous and closed on the sheets, can be achieved by adapting the amount of particulate zinc phosphate in the activation to the amount of free fluoride and the amount of dissolved aluminum in the zinc phosphating (CRS-L-A1-h; CRS-H-A1-I; CRS-H-A2-I; CRS-H-A3-I). If the amount of particulate zinc phosphate in the activation falls below the value defined by the free fluoride amount and the concentration of dissolved aluminum, either non-homogeneous coatings are achieved (CRS-L-A2-I; CRS-L-A3-h) or the phosphate coatings are virtually closed, the substrate surface nevertheless remaining visible after phosphating (CRS-L-A1-I; CRS-L-A2-h). Even on aluminum, closed phosphate coatings are produced in the method variants according to the invention in accordance with table 1, such that the suitability of the method according to the invention for the corrosion-protective treatment of a series of components that comprise components having surfaces of iron and surfaces of aluminum is demonstrated.

TABLE 1

| Example[1] | Activation $PO_4$/ $mmolkg^{-1}$ | Zinc phosphating, pH: 3.0 [F]*/$mmolkg^{-1}$ | [Al]**/$mmolkg^{-1}$ | 0.07·Term# | Coating weight/ $gm^{-2}$ | Appearance 0: closed homogeneous layer 1: almost closed, but shimmering substrate surface |
|---|---|---|---|---|---|---|
| CRS-L-A1-l | 0.63 | 4.9 | 29.7 | 0.62 | 1.5 | 1 |
| CRS-L-A1- | 0.63 | 14.8 | 29.7 | 0.50 | 1.8 | 0 |
| AA-L-A1-l | 0.63 | 4.9 | 29.7 | 0.62 | 1.2 | 1 |
| AA-L-A1-h | 0.63 | 14.8 | 29.7 | 0.50 | 1.4 | 0 |
| CRS-H-A1-l | 3.57 | 4.9 | 29.7 | 0.62 | 1.8 | 0 |
| AA-H-A1-l | 3.57 | 4.9 | 29.7 | 0.62 | 1.5 | 0 |
| CRS-L-A2-l | 0.63 | 6.2 | 37.0 | 0.76 | — | 2 |
| CRS-L-A2- | 0.63 | 18.5 | 37.0 | 0.62 | 1.5 | 1 |
| AA-L-A2-l | 0.63 | 6.2 | 37.0 | 0.76 | — | 2 |
| AA-L-A2-h | 0.63 | 18.5 | 37.0 | 0.62 | 1.2 | 1 |
| CRS-H-A2-l | 3.57 | 6.2 | 37.0 | 0.76 | 1.7 | 0 |
| AA-H-A2-l | 3.57 | 6.2 | 37.0 | 0.76 | 1.5 | 0 |
| CRS-L-A3- | 0.72 | 27.5 | 55.6 | 0.94 | — | 2 |
| AA-L-A3-h | 0.72 | 27.5 | 55.6 | 0.94 | — | 2 |
| CRS-H-A3-l | 3.57 | 9.3 | 55.6 | 1.15 | 1.6 | 0 |
| AA-H-A3-l | 3.57 | 9.3 | 55.6 | 1.15 | 1.2 | 0 |

[1]The first letters indicate the substrate; L (low) and H (high) the content of $PO_4$ in the activation; A1 to A3 the increasing content of aluminum in the zinc phosphating; and the last letter l (low) and h (high) the content of free fluoride in the zinc phosphating
*free fluoride measured with ion meter pMX 3000/Ion (Xylem Inc.); source: ammonium bifluoride
**source: aluminum trichloride

What is claimed is:

1. A method for an anti-corrosion treatment of a series of metal components, the series comprising components that have, at least in part, iron surfaces, in which method the metal components of the series successively undergo the following wet-chemical treatment steps:

(I) activation by contacting the metal components with an alkaline aqueous dispersion that has a D50 value of less than 3 μm and an inorganic particulate constituent of which comprises phosphates being composed at least in part of hopeite, phosphophyllite, scholzite and/or hureaulite, the phosphates from the inorganic particulate constituent being present in the alkaline aqueous dispersion in an amount less than 0.8 g/kg calculated as $PO_4$ and based on the dispersion;

(II) zinc phosphating by contacting the metal components from step (I) with an acidic aqueous composition containing (a) 5-50 g/l of phosphate ions, (b) 0.3-3 g/l of zinc ions, (c) at least 15 mmol/kg of aluminum ions in dissolved form, and (d) at least one source of fluoride ions, wherein the concentration of free fluoride in the acidic aqueous composition is at least 0.5 mmol/kg, wherein the concentration of phosphates in the form of particulate phosphate in mmol/kg, calculated as $PO_4$ in the alkaline aqueous dispersion, is greater than seven hundredths of the following term in mmol/kg:

$$\frac{[Al]^2}{3[Al]+[F]\cdot(1+10^{3.12-pH})} \quad \text{(Eq. 1)}$$

[Al]: concentration of aluminum ions in dissolved form in mmol/kg

[F]: concentration of free fluoride in mmol/kg pH: pH of the acidic aqueous composition of the zinc phosphating.

2. The method according to claim 1, wherein the proportion of phosphates based on the inorganic particulate constituents of the alkaline aqueous dispersion of step (I), is at least 30 wt. %, calculated as $PO_4$.

3. The method according to claim 1, wherein the proportion of zinc in the inorganic particulate constituent of the alkaline aqueous dispersion of step (I), is at least 20 wt. %.

4. The method according to claim 1, wherein the proportion of titanium in the inorganic particulate constituent of the alkaline aqueous dispersion of step (I), is less than 5 wt. %.

5. The method according to claim 1, wherein the amount of phosphates from the inorganic particulate constituent of the alkaline aqueous dispersion of step (I), is at least 40 mg/kg, calculated as $PO_4$ and based on the dispersion.

6. The method according to claim 1, wherein the pH of the alkaline aqueous dispersion of step (I), is greater than 8, but less than 12.

7. The method according to claim 1, wherein, in the acidic aqueous composition of the zinc phosphating, the total concentration, in mmol/kg, of sodium and/or potassium ions in dissolved form is less than the number 40 divided by the third root of the concentration of aluminum ions in dissolved form.

8. The method according to claim 1, wherein the concentration of aluminum ions in dissolved form in the acidic aqueous composition of the zinc phosphating is greater than 30 mmol/kg, but less than 100 mmol/kg.

9. The method according to claim 1, wherein the concentration of free fluoride is at least 2 mmol/kg, but not greater than 50 mmol/kg.

10. The method according to claim 1, wherein the pH in the acidic aqueous composition of the zinc phosphating is greater than 2.5, but less than 3.5.

11. The method according to claim 1, wherein neither a rinsing nor a drying step takes place between the activation and the zinc phosphating.

12. The method according to claim 1, wherein within the series, components that have aluminum surfaces and/or components that have aluminum surfaces in addition to the iron surfaces are also treated.

13. The method according to claim 12, wherein each component of the series is of the same composition and a pickling rate of aluminum based on the surface area of each component in the zinc phosphating is not greater than:

$$0.27 \cdot \frac{A}{100} \mathrm{gm}^{-2} \quad \text{(Eq. 2)}$$

A: actual drag-out from the zinc phosphating bath indicated in milliliters of the acidic aqueous composition per component and per square meter of the component.

14. The method according to claim 12, wherein each component of the series is of the same composition and a pickling rate of aluminum based on the surface area of each component in the zinc phosphating is greater than:

$$0.27 \cdot \frac{A}{100} \mathrm{gm}^{-2} \quad \text{(Eq. 2)}$$

A: actual drag-out from the zinc phosphating bath indicated in milliliters of the acidic aqueous composition per component and per square meter of the component;

wherein a partial volume of the acidic aqueous composition is removed continuously or discontinuously from the zinc phosphating and an equally large partial volume is supplied continuously or discontinuously to the zinc phosphating by means of one or more aqueous compositions of this kind, which in each case, based on the partial volume, have a higher concentration in comparison to the concentration of the corresponding ions in the removed partial volume, with respect to the phosphate ions, zinc ions and/or the source of fluoride ions, but, with respect to the aluminum ions in dissolved form, have a lower concentration than in the removed partial volume.

15. The method according to claim 1, wherein after the zinc phosphating, the metal components are subjected to a rinsing step and no drying step, followed by electrocoating.

16. The method according to claim 1, wherein the amount of phosphates from the inorganic particulate constituent in the alkaline aqueous dispersion is less than 0.4 g/kg calculated as $PO_4$ based on the dispersion.

17. The method of claim 1, wherein the acidic aqueous composition includes less than 10 ppm of cobalt.

* * * * *